US007611396B2

(12) United States Patent
Schnuckle

(10) Patent No.: US 7,611,396 B2
(45) Date of Patent: Nov. 3, 2009

(54) ILLUMINATED BALLOON WITH AN EXTERNALLY MOUNTED, REAR PROJECTOR

(75) Inventor: Gary W. Schnuckle, Altadena, CA (US)

(73) Assignee: Disney Enterprises, Inc., Burbank, CA (US)

( * ) Notice: Subject to any disclaimer, the term of this patent is extended or adjusted under 35 U.S.C. 154(b) by 359 days.

(21) Appl. No.: 11/679,604

(22) Filed: Feb. 27, 2007

(65) Prior Publication Data

US 2008/0207083 A1 Aug. 28, 2008

(51) Int. Cl.
*A63H 3/06* (2006.01)

(52) U.S. Cl. ..... 446/220; 348/744

(58) Field of Classification Search ..... 446/220; 348/744

See application file for complete search history.

(56) References Cited

U.S. PATENT DOCUMENTS

| | | | | | |
|---|---|---|---|---|---|
| 1,789,212 | A * | 1/1931 | Bergve | ..... | 353/67 |
| 2,090,086 | A * | 8/1937 | Weiner | ..... | 116/310 |
| 2,592,444 | A * | 4/1952 | Matelena | ..... | 353/13 |
| 3,672,083 | A * | 6/1972 | Moran | ..... | 40/540 |
| 3,745,677 | A * | 7/1973 | Moran | ..... | 40/540 |
| 4,101,373 | A * | 7/1978 | Schiffman | ..... | 216/48 |
| 4,802,734 | A | 2/1989 | Walter | | |
| 4,859,053 | A * | 8/1989 | Nicolas | ..... | 353/74 |
| 4,997,403 | A | 3/1991 | Akman | | |
| 5,117,344 | A * | 5/1992 | Perez | ..... | 362/352 |
| 5,215,492 | A | 6/1993 | Kubiatowicz | | |
| 5,807,157 | A | 9/1998 | Penjuke | | |
| 5,857,760 | A | 1/1999 | Pelton | | |
| 5,947,581 | A * | 9/1999 | Schrimmer et al. | ..... | 362/96 |
| 6,238,067 | B1 | 5/2001 | Hirsch | | |
| 6,390,651 | B2 | 5/2002 | Bertrand | | |
| 6,739,725 | B2 | 5/2004 | Ben-Ari | | |
| 7,036,958 | B2 | 5/2006 | Hayne et al. | | |
| 7,077,553 | B2 | 7/2006 | Vanderschuit | | |
| 7,204,740 | B2 | 4/2007 | Petell | | |
| 2002/0145863 | A1 | 10/2002 | Stultz | | |
| 2002/0171927 | A1 * | 11/2002 | Barnes, III | ..... | 359/451 |
| 2004/0174718 | A1 | 9/2004 | Ohlund | | |
| 2004/0233674 | A1 * | 11/2004 | Vanderschuit | ..... | 362/352 |
| 2006/0104070 | A1 | 5/2006 | Carito | | |

* cited by examiner

*Primary Examiner*—Gene Kim
*Assistant Examiner*—Matthew B Stanczak
(74) *Attorney, Agent, or Firm*—Marsh Fischmann & Breyfogle LLP; Kent A. Lembke

(57) ABSTRACT

An illuminated balloon assembly. The assembly includes a balloon having a front wall and a transparent rear wall or a rear wall including a transparent area. A projector is mounted on an exterior surface of the rear wall. The projector has a housing with an outlet proximate to the transparent area of the rear wall and a light source directing light toward the housing outlet. A light filter element is positioned within the housing such that light is selectively filtered to cause a display image to project on the balloon front wall. The housing has upper and lower shells, with the upper shell rigidly attached to the rear wall and supporting the light source. The lower shell is pivotally mounted on the upper shell. The filter is a two piece construction with portions provided on the upper and lower shells to cause the display to animated by projector movement.

17 Claims, 5 Drawing Sheets

ILLUMINATED BALLOON WITH AN EXTERNALLY MOUNTED, REAR PROJECTOR

BACKGROUND OF THE INVENTION

1. Field of the Invention

The present invention relates, in general, to methods and devices for illuminating inflated devices such as balloons and, more particularly, to an illuminated balloon that uses an externally mounted rear projector to display a pattern or design with moving or animated portions onto an internal surface of the balloon.

2. Relevant Background

Balloons have long been used as novelty toys such as at circuses, fairs, and amusement parks and as decorations at parties. Balloons may be inflated with air or with buoyant gases such as helium to cause them to float upon a string or other tether. Balloons were initially only provided with differing colors but soon were covered with many colorful designs, artwork, and messages. Other advances in balloons include the wide range of materials that are now used for balloons including rubber or latex based balloons to foil balloons formed of metallized nylon or of biaxially-oriented polyethylene terephthalate (boPET) polyester films (e.g., commonly referred to as Mylar®) and other materials.

More recently, balloons have been made even more distinctive with internal illumination. For example, many illuminated balloons have been created that light the interior surfaces of the balloon by placing a light source inside the balloon. The illuminated balloon can then be used as a novelty toy such as for evening events or even used in some cases as a source for area lighting. The light sources are typically battery operated and operate continuously with no power switch and only for the life of the battery. Battery life often has to be balanced against battery weight that has to be overcome by the buoyancy of the balloon and against cost that generally has to be kept quite low to make the illuminated balloon a desirable toy or decoration.

Another difficulty with illuminating internal surfaces of balloons is the amount of heat generated by the light source. Light sources generate heat and contact with the light source may form a hole in the balloon wall or "pop", the inflated balloon. Recently, light emitting diodes (LEDs) have been utilized as internal light sources, but even LEDs generate heat that can damage a balloon wall. As a result, illuminated balloons have been developed that include support structures that physically house or support the light source and its power source or battery and that attempt to keep the light source positioned apart from the balloon wall. Other support or housing structures for the light source simply attempt to provide a barrier against the heat reaching the balloon wall. In either case, the internal structures have often been relatively complex, have added weight to the balloon, and have increased the overall cost of the illuminated balloon. Additionally, the balloons are typically only useful for the life of the battery.

There remains a demand for novelty balloons (note, any inflated device may be considered a "balloon" for this description) with illuminated internal surfaces. Preferably such illuminated balloons would be inexpensive to manufacture, would be relatively light in structure, and would provide a power source that has extended life or that can be replaced (e.g., a battery that can readily be changed).

SUMMARY OF THE INVENTION

The present invention addresses the above problems by providing an assembly that includes a balloon that is illuminated with a projector that is mounted on a rear wall exterior to the balloon similar to a rear projection television with an inner surface of the front wall of the balloon acting as the projection screen. The front wall of the balloon may be painted or colored white or another color to better perform as a screen and the rear wall of the balloon is clear or at least translucent to light or a projection window is provided at the mounting location for the projector. The projector in some embodiments includes a two piece housing in which an upper shell or shroud is affixed to the rear wall of the balloon and a lower shell or shroud is pivotally mounted to the upper shell so as to be able to rock or move in response to movement of the balloon. A light source is provided in the upper shell to transmit light through the outlet of the projector housing and the rear wall of the balloon. An image or pattern is displayed upon the front wall of the balloon by providing an artwork pattern or light filtering/blocking element at the housing outlet. In one embodiment, the filtering element is also a two piece construction with an upper portion mounted to the upper shell and a lower portion mounted to the lower shell. In this manner, the display includes a stationary or stable component or portion and also a mobile component or portion (i.e., a portion in which the display location varies with movement of the lower shell in the projector housing), and the projector of the invention may be thought of as being a motion animated projection device. Instead of being motion animated, the animation may be provided by wind or air movement actuation such as by placing the assembly in a location (such as hung from a ceiling, tethered to a shelf, tethered to the ground in an outdoor setting, or the like) where wind or air movement causes the balloon and attached projector to move. Unique displays are generated that include changing displays such as a talking head, a face with moving eyes or lips, and many other displays that are only limited by the imagination of an artisan or designer.

More particularly, one embodiment of the invention provides an illuminated, inflatable display assembly or apparatus. The assembly includes an inflatable balloon having a front wall and a rear wall with the rear wall being substantially transparent or including an area or window that is at least partially transparent to light. The assembly further includes a projector that is positioned exterior to and adjacent to the rear wall of the balloon. The projector has a housing with an outlet proximate to the transparent area of the rear wall and a light source directing light toward the housing outlet. An artwork pattern or light filter element is positioned within the housing such that light from the light source is selectively filtered by (or selectively passes through) the filter element to cause a display image defined by the filter element or artwork pattern to be projected on an inner surface of the front wall of the balloon. The light filter element may be a simple mechanical filter or pattern that filters light (e.g., white or colored light) while in some embodiments the filter element is variable such as may be provided by a digital light blocker that can change its pattern over time or in response to external stimuli (e.g., a liquid crystal screen or the like). Further, the artwork may provide a colored display or output by being provided with one or more colors such as translucent colored films of varying colors, and in these embodiments, the light source may be a white light source or be a colored source. Yet further, the use of the term light source herein generally refers to the use of at least one LED, bulb, or other source but clearly is intended to include the use of two or more LEDs, bulbs, or other sources to create a desired display.

In some embodiments, the housing is a two piece construction with a first shell or shroud and a second shell or shroud. The first shell, which in some cases is the upper shell, supports the light source and also provides a pivotal mounting for the second shell. The two shells act together to direct light from the light source toward the rear wall and, in this regard, the shells define the outlet of the housing. The first shell contacts or abuts the exterior surface of the rear wall of the balloon such that the first shell is immobile relative to the rear wall while the second shell does not abut the rear wall and is free to move relative to the first shell and rear wall (e.g., to pivot about the mounting to the first shell which may be a pin, a rocker arm, a hinge arrangement, or the like) such as in an up and down travel path (e.g., vertical movements). The first shell may have a frustoconical sidewall formed of a substantially opaque material (such as white or other colored plastic or other material) and include a slot sized to receive the second shell as it pivots about its mounting to the first shell. The front wall of the balloon may be colored or painted to provide a more effective projector screen (such as painted white) and the rear wall balloon may be formed of material that is clear to transparent or at least translucent to light to allow projection of the filtered light from the light source onto the inner surface of the front wall.

According to another aspect of the invention, an apparatus is provided for forming a balloon with a wall with a transparent portion or window into an illuminated balloon display device. The apparatus includes an upper shell with an inner surface that supports an upper display pattern. The upper shell is configured for mounting upon an exterior surface of the balloon wall adjacent the transparent window of the balloon. A light source is positioned in the apparatus, such as on the inner surface of the upper shell, to direct light through the upper display pattern on the inner surface of the upper shell. A lower shell is also provided with an inner surface supporting a lower display pattern. The lower shell is pivotally mounted to the upper shell so as to move the lower display pattern toward and away from the inner surface of the upper shell, e.g., in response to movement of the upper shell. The display patterns are typically at least partially opaque to block some of the light from the light source to define a pattern or display image to be projected upon an inner surface of the balloon opposite the transparent window or mounting location of the upper shell. In some embodiments, the inner surface of the upper shell has an arcuate cross section with a gap that is sized to receive the lower shell as it moves toward the inner surface. Further, in some cases, the lower shell has an outer edge that is recessed, e.g., as measured from a plane passing through an outer edge of the upper shell, such that the lower ledge does not contact the exterior surface of the balloon when the upper shell is mounted on the exterior surface.

DETAILED DESCRIPTION OF THE PREFERRED EMBODIMENTS

Briefly, the present invention is directed to an illuminated balloon assembly that includes a projector that is mounted on the outer or exterior surface of the back or rear wall of the balloon to illuminate the inner or interior surface of the front wall of the balloon. The projector includes a housing made up of an upper shroud or shell and a lower shroud or shell that directs the light through the back wall of the balloon, which is at least translucent to light in the area where the projector is mounted. The lower shroud is mounted in the housing to pivot up and down (or into the upper shroud and out of or away from the upper shroud) such as by mounting onto a hinge, a pin, a rocker arm, or the like supported by the upper shroud. Art work or patterns for display are mounted on the upper and lower shrouds such that when the balloon is moved about the lower jaw and associated art work or patterns also move. As a result, the image displayed upon the inner surface of the front wall includes a still or stationary portion created as light from a light source mounted in the projector passes through the art work or pattern mounted on the upper shroud and a moving or varying portion as light from the light source passes through the art work or pattern mounted on the lower shroud and rear wall of the balloon (e.g., a face with a moving lower jaw or a face with eyes that move). In other embodiments, the art work or patterns are mounted on one or more springs or other flexible members attached to the upper shroud (e.g., instead of providing a pivoting lower shroud), to the balloon itself), or to the lower shroud (e.g., to provide to forms of movement or in cases where the lower shroud is fixed in place upon the upper shroud), and the springs or flexible members move or vibrate in response to movement of the projector causing the art work or pattern to also move and provide an animated display.

The light source may be powered by a battery provided at the projector or by a battery or other power source connected to the projector by a wire (e.g., a wire that extends from the projector through a tube or conduit to a handle with the tube acting as the tether or string for the balloon). In some cases, the power source may be a solar cell or a solar power-based device such as a thin film voltaic panel or the like that is provided on an exterior surface of the projector, attached to the balloon itself, or otherwise mounted for exposure to the sun or light sources. The external mounting of the projector allows the balloon to be inflated with air or buoyant gas such as helium as conventional balloons and the projector to be attached such as with use of the power wire and additional straps (e.g., rubber bands, string, wire, adhesive tape, or the like) extending from the projector housing to mounting eyelets on the outer surface of the balloon.

Figure 1:
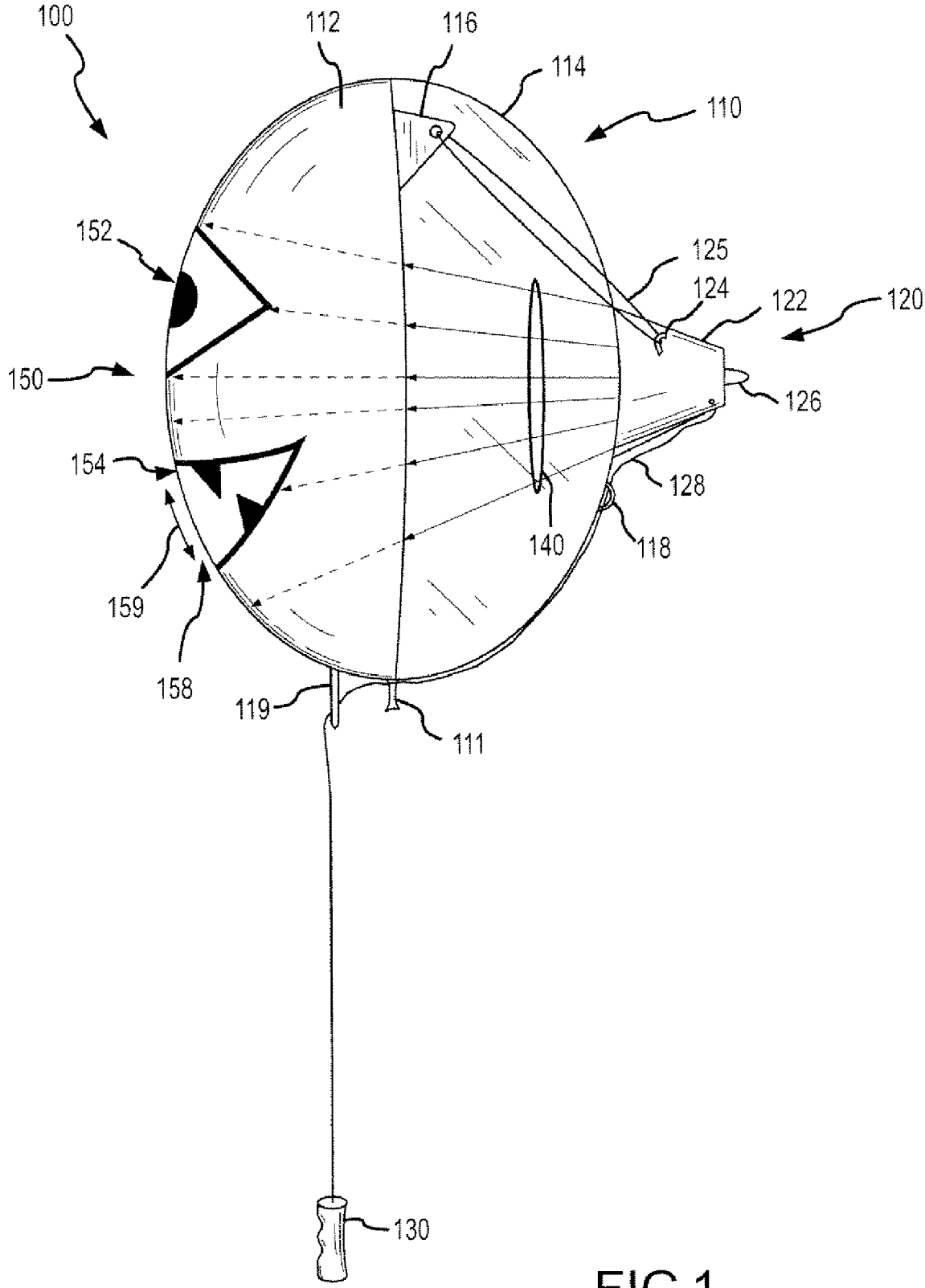
FIG. 1 is a side view of an illuminated balloon assembly of one embodiment of the invention illustrating a rear projector that is externally mounted.

FIG. 1 illustrates an illuminated balloon assembly 100 of one embodiment of the present invention. The assembly 100 is configured for illuminating interior surfaces of a balloon 110 with a rear and exterior mounted projector 120 to create a displayed image 150 with stationary portions or components 152, 154 and portions 158 that move or have varying display locations relative to the stationary components 152, 154 as shown with arrow 159. The balloon or inflatable device 110 may be formed as a unitary body balloon such as is common for latex and similar elastic material balloons. More typically, as shown, the balloon 110 may be a two piece construction balloon with a front wall 112 and a rear wall 114. For example, the balloon may be a nylon, a boPET, or other material balloon 110 that may include metallized surfaces (e.g., the rear wall 114 may be metallized with a clear window through which the projector 120 directs light). In some embodiments, the rear wall 114 is clear to at least partially translucent to allow light from the projector 120 to pass, and the interior surface of the front wall 112 acts as a screen for display 150 generated by the projector 120. To provide a screen, the front wall is typically colored such as white or using other coloring that may be applied to the inner or outer surface of the front wall 112 or be provided by selecting a dyed or colored material for the front wall 112 (e.g., a white nylon, latex, boPET, or the like). The balloon 110 includes an inlet or inflation neck 111 and is typically filled or inflated with air or more typically a lighter than air gas such as helium.

A projector 120 is attached or mounted onto the rear wall 114 of the balloon 110 such that it directs light from its light source 126 (e.g., one or more colored or white LEDs, incandescent light bulbs, or the like). A projector housing 122 is used to support the light source 126 (and also to mount the art work or patterns used to project the display 150 on the front wall 112 as explained in more detail with reference to FIGS. 4-6). The projector 120 is attached to the balloon 110 in this embodiment by passing a strap, sting, wire, elastic band, or the like 125 through mounting eyelets, loops, or heat-welded plastic strips 124 on the sides of the housing 122 (such as 2 eyelets) and to two or more mounting eyelets or guides (or heat welded plastic strips or the like) 116 provided on the sides of the balloon 110 such as part of the front or rear wall 112 or 114 at the seam or at another location. Two eyelets 116 are used in the embodiment shown in FIGS. 1 and 2 but other numbers may be used. To more firmly attach the projector, the power wire 128 (or ribbon with electrically conductive strip, wiring, or the like) from the light source 126 is run through one or more eyelets or guides 118 on the exterior surface of the rear wall 114 and also through a guide or eyelet (or heat-welded plastic or other material strip) 119 that is provided at the bottom of the balloon 110 and forward of the seam or center line of the balloon 110 on the exterior surface of the front wall 112. The position of the front wall guide 119 is selected in the illustrated embodiment to be off center such that the balloon assembly 100 is balanced. i.e., with the handle or battery casing 130 acts as a counterbalance to the added weight of the projector 120 and its mounting assembly (e.g., straps 125) such that the balloon 110 does not float with its front wall 112 tilted upward or such that a plane passing through the seam or center line of the balloon 110 is substantially perpendicular to the ground for example as would be the case if the projector 120 were not provided on the balloon 110. In other embodiments, a similar balancing effect is achieved by placing the guide 119 at or near the seam such as near inlet 111 and designing the guide 119 with an elongate tube or other structure that extends the wire 128 outward from the seam so as to provide a cantilevered or levered effect. In this manner, the sire 128 and handle 130 are also positioned off-center in relation to the seam of the balloon 110 so as to counterbalance the weight of the projector 120.

The wire 128 extends to the handle 130, which in some cases is a casing for a battery for the light source 126. In other embodiments, a watch or similar battery is provided at the projector 120 and the wire 128 is simply a mounting strap. Having a watch battery at the projector 120 may not be desirable in many cases as it adds weight to the projector 120 and also because watch and other small batteries are often more expensive than more conventional batteries (which, in turn, are much larger and heavier such as AA, AAA, and other alkaline batteries). However, the handle 130 may be configured as a casing for such larger, heavier batteries so as to provide a less expensive way to power the light source 126, and the use of handle 130 as a casing for a battery or batteries allows for ready replacement as necessary to extend the life of the assembly 100. The wire 128 may also be placed in a tube or conduit such as a flexible rubber or plastic (e.g., polypropylene or the like) that may extend down from the front guide 119, and, in either case, the handle 130 and wire 128/conduit act as a tether for the balloon 110 to allow a user to hold the balloon 110. In embodiments in which the assembly 100 may be used as a decoration that would not be moved while in use, the power source/handle 130 may include a plug to allow a standard electrical socket or cord to be used to power the projector 120. In some embodiments, the assembly 100 is hung from a ceiling or from above by a support (e.g., a lantern or similar object hung from a hook or the like) and in these embodiments, the handle 130 may be replaced or supplemented with attachment hardware for facilitating supporting the assembly 100 from above (e.g., the assembly 100 as shown in FIG. 1 would be turned upside down to be with the balloon hanging downward from its upper support or tether point). In these cases, the balloon 110 would typically be filled with air or gases/liquids that are heavier than air but this is not a requirement to practice the invention. In these embodiments, the casing or mounting structure 130 may again be used to contain the power source but weight may not be as large of a concern which may lead to providing the power source in the projector 120 or on the balloon 110 or via a power cord (e.g., line 128) as is the case with a decoration tethered from below.

As shown, the projector 120 outputs or projects light 140 that illuminates the interior of the balloon 110. More specifically, the projector housing 122 and light source 126 are configured such that the light 140 is directed onto the inner surface of the front wall 112 to create the display or light imagery 150. The display 150, for example, may be a face or any other pattern that is formed by light passing out of the housing 122. Typically, a pattern element or filter is provided at the outlet of the housing 122 to define the display 150 (i.e., by blocking portions of the light generated by source 126). For example, the display 150 may be defined by artwork or a pattern in such as filter to form a face or other object on the inner surface of the front wall 112. In some preferred embodiments, the display 150 includes stationary components or portions 152, 154 and mobile or moving portions (i.e., portions that have more than one display location over time) 158, with the movement shown by line 159. As will become clear, this is generally achieved by using a two or more piece pattern element or filter at the outlet of housing 122 to block differing portions of the light from source 120 including a piece(s) that is fixed in location and a piece(s) that move (e.g., pivot about a point or slide within a groove or the like, art work provided on springs or flexible members, a varying filter such as may be provided by a translucent digital filter such as an LCD or the like, or other filter element).

Figure 2:
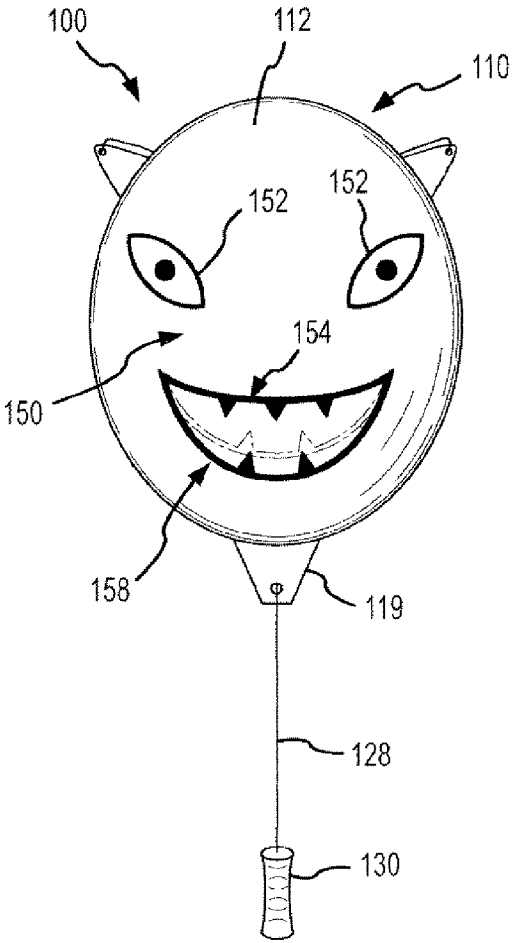
FIG. 2 is a front view of the balloon assembly of FIG. 1 further illustrating the image display including stationary and moving portions as generated by the rear projector.

FIG. 2 illustrates a front view of the illuminated balloon assembly 100 with the projector 120 operating to create a display 150 on the front wall 112 of the balloon 110. In the illustrated embodiment, the display 150 is a face with fixed or stationary components 152, 154 that include eyes and upper portions of a mouth/jaw. The display 150 also includes mobile or moving components or portions 158 as shown at 159 that include lower portions of a mouth/jaw. As the balloon 110 is moved, such as by a user pulling on the handle 130 to force the balloon 110 downward via wire/tether 128 and front guide 119, the mobile portions 158 move in response as shown at 159 while the other portions 152, 154 remain stable so as to provide the effect of a mouth that changes (e.g., biting, talking, or the like).

Figure 3:
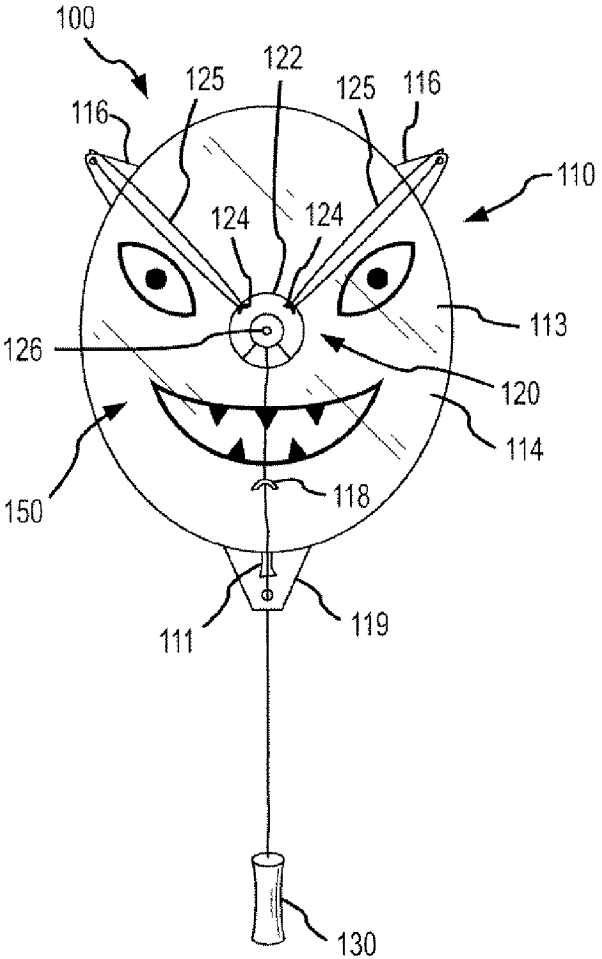
FIG. 3 is a back or rear view of the balloon assembly of FIGS. 1 and 2 further illustrating the mounting structure or assembly for the rear projector and showing that all of rear wall or surface (or a portion near the projector) is translucent or clear to allow the projection of the display from the rear of the balloon.

FIG. 3 illustrates a rear view of the balloon assembly 100. Because the rear wall 114 is generally clear or at least translucent, the inner surface 113 of the front wall is visible with the displayed image 150 (but, as discussed, in some cases, a window or opening in coloring provided on the wall 114 may be used to provide a path for light from the projector 120). As shown, the attachment or mounting of the projector 120 is achieved with the straps or bands 125 that extend from eyelets or guides (e.g., solid eyelets or an open hook/eyelet/guide configurations) 124 on the housing 122 to eyelets or guides 116 on the balloon exterior surface, such as on the rear wall 114 or on the front wall 112. Two bands or straps 125, such as rubber bands or the like, are shown but some embodiments only use one and others include additional attachment points 116 to the balloon (and 1 to 3 or more straps). The attachment method or assembly further uses the power (or control in some cases) wire 128 that extends out from the housing 122 down along the exterior of rear wall 114 through rear guide(s) 118 and front guide 119 to handle (or power source casing) 130.

Figure 4:
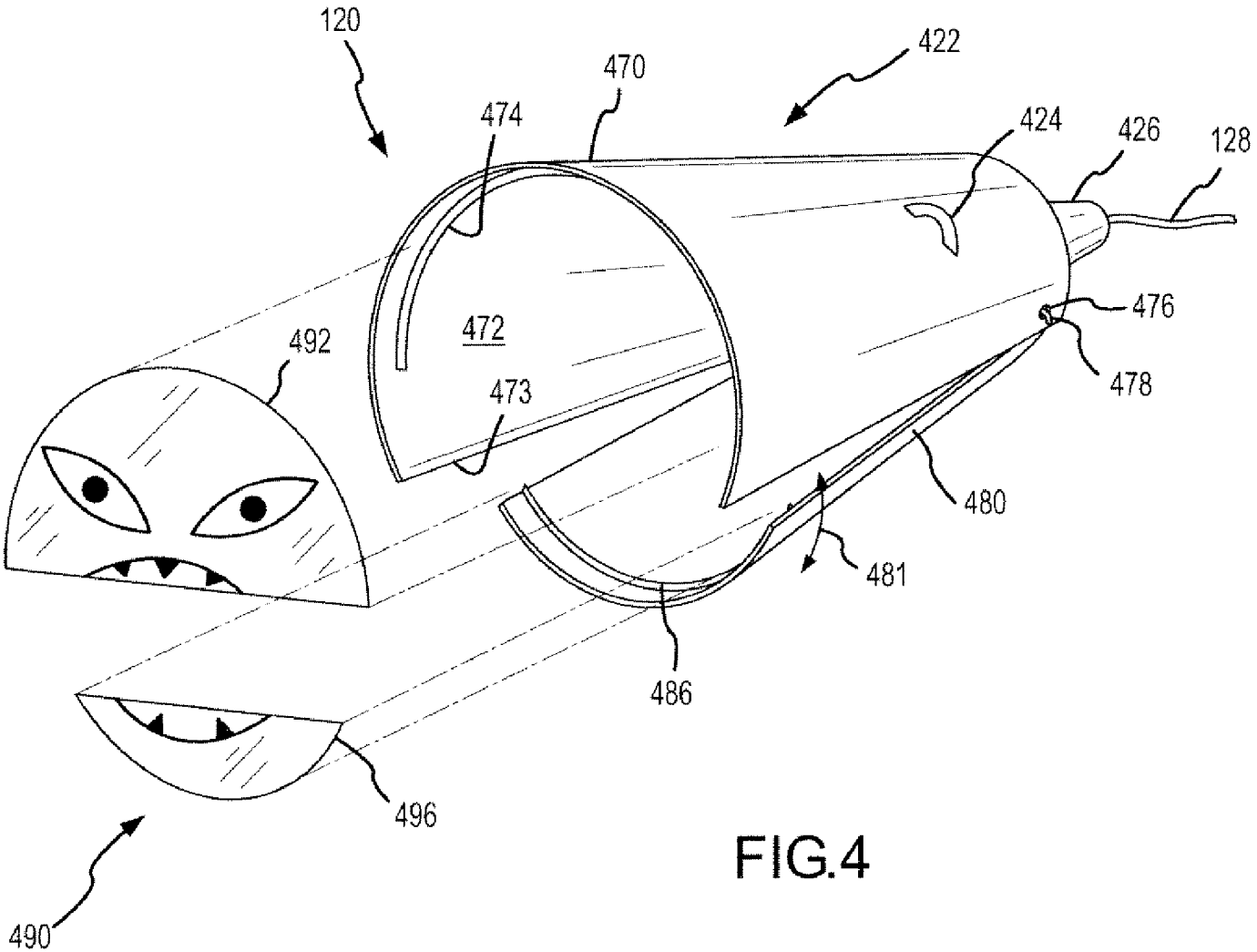
FIG. 4 is an exploded perspective view of one embodiment of a projector of the present invention illustrating a two piece shroud or shell for directing light away from a light source through two pieces of art work or display patterns (e.g., one that moves and one that does not)

FIG. 4 is an exploded view of one embodiment of the projector 120. The view is exploded in the sense that the display pattern or filter 490 is shown detached from the projector housing 422. As shown, the filter 490 is formed with two pieces 492 and 496 that combine to define or provide a display by allowing light from a light source 426 to selectively pass out of the housing 422. The upper or fixed piece 492 is glued or otherwise attached to the upper shroud or shell 470 while the lower or mobile piece 496 is glued or otherwise attached to the lower shroud or shell 480. Each piece 492, 496 includes opaque or less translucent areas (e.g., artwork or patterns or designs) that block light from the source 426 when affixed to the housing 422 and the source 426 is operated. The light that is not blocked (i.e., light 140 in FIG. 1) is transmitted out from the housing outlet and directed or focused to strike the inner surface of the front wall (i.e., surface 113 of front wall 112 shown in FIG. 3).

The housing 422 is generally conical in shape in the illustrated embodiment although other arrangements may be used to provide the function of directing the light from source 426 out of an opening that is positioned against or proximate an exterior surface of a clear rear wall (or window in such wall). The upper shroud 470 generally is somewhat longer than the lower shroud 480 such that the lower shroud 480 does not abut or contact the exterior surface of the rear wall when the projector 420 is mounted on a balloon. For example, the lower shroud 480 may have its end recessed from the end of the upper shroud 470 about 0.125 to 0.25 inches or more such that there is a clearance between the lower shroud 480 and the balloon to allow the lower shroud 480 to move. The lower shroud 480 is attached to the upper shroud 470 so that it can move relative to the upper shroud 470. This pivotal or relative motion-type mounting may be achieved in a number of ways, and as shown, is achieved through the use of a rocker arm, rod, or pin 478 that extends through a hole 476 in the upper shroud 470 (and through an eyelet, guide, sleeve, or the like on the lower shroud as seen at 510 in FIG. 5). The connection in these cases can be thought to be a hinged attachment or a pivotal mounting that allows the lower shroud or shell 480 to pivot or rotate about its mounting point on the pin 478. The lower piece of the filter 496 is attached to the edge of the shell 480 or to a shelf 486 that may be at the edge or offset some distance from the edge. As a result, in operation, the lower piece of the filter 496 moves with the lower shell 480 (as shown with arrow 481) and provides movement or animation to a display (such as display 150) created by projector 120. In other embodiments, the motion of part of the filter is achieved through the use of a digital or electronic filter that varies its display (such as an LCD screen) or by mounting the filter 490 completely or partially upon a flexible member or spring which in turn may be mounted to the upper shroud 470, to the lower shroud 480 (which may be mounted for movement as shown or rigidly attached to the upper shroud 470), to the balloon itself, or some combination of these mounting techniques/locations. Similarly, while only two components 492, 496 are shown to be included in the filter 490, it will be readily understood that more or fewer filter components may be provided to achieve a desired display or animated/stationary combination.

The upper shroud or shell 470 is shown to be a partial cone (i.e., is frustoconical in shape) with an edge 473 defining an opening or slot in for receiving the lower shroud or shell 480 as it pivots on pin or rocker arm 478 upward or toward the shell 470. The inner surface 472 of the upper shell 470 may include a shelf 474 on which the art work or upper piece of the filter 492 is glued or otherwise attached or the upper piece of the filter 492 may be attached to the outer edge of the shell 470. Typically, the filter 490 is positioned inward from the edge of the shells 470, 480 so as to not be in contact with the balloon, which may cause distortion or damage the filter 490. The shelves or ledges 474, 486 may be aligned with each other such that the filter pieces 492, 496 contact each other or slightly overlap when the lower shell 480 is positioned within the upper shell 470 (e.g., travel of the lower shell 480 about the pin 478 may be limited by abutting contact between the pieces 492, 496 on the shelves 474, 486, by contact with one of the pieces 492, 496 and the shells 470, 480, or by other stops (not shown)). The upper shell 470 also is shown to include the mounting guide or eyelet 424 through or around which a mounting strap may be run. Also shown are a light source 426 (or this may be portion of the shell 470 in which a light source is positioned such as an LED or the like most of the source inside the shell 470) and its power/control line(s) 128 extending out from the source 426 or housing.

Figure 5:
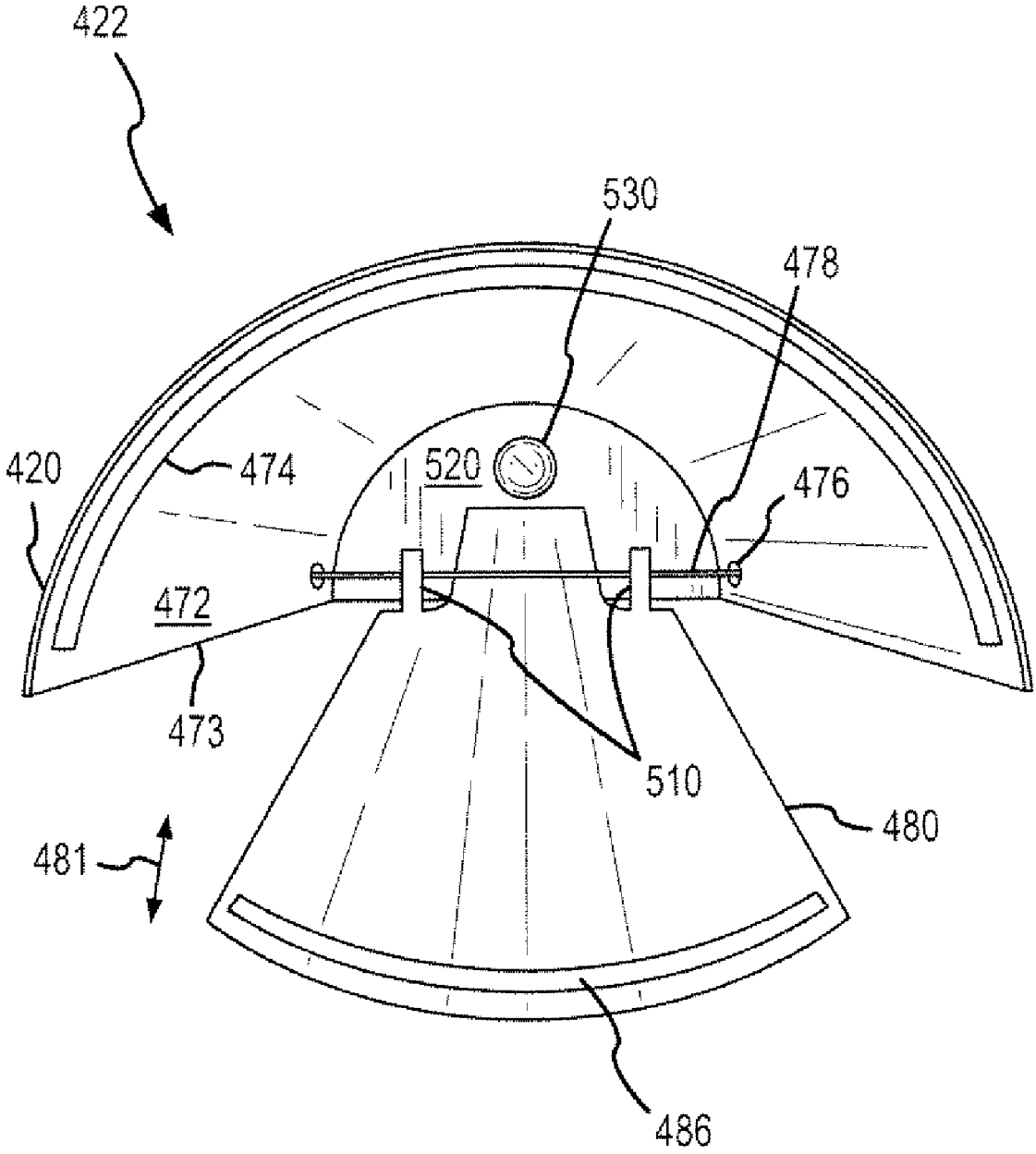
FIG. 5 is a front end view of the projector shroud or shell with the art work or display patterns removed (not yet installed) to show the rocker arm/pivot pin used to allow the lower or bottom part of the shroud to move and showing the light source.

FIG. 5 illustrates the projector housing 422 of FIG. 4 in an end view, i.e., from the outlet or projection end that would be positioned against the rear wall of the balloon. The artwork pattern or filter 490 of FIG. 4 is not installed but would be positioned upon shelves or ledges 474 and 486 of the upper and lower shells 470, 480. With the filter 490 removed, the internal arrangement of the projector and housing 422 can better be seen. The upper shell or shroud 470 includes the inner surface 472 and an inner edge 473 that defines a cut out portion or slot through which the lower shell or shroud 480 may travel as it pivots or swivels on pin or rocker arm 478. The rotational pin 478 is supported by the upper shell 470 by openings or holes 476 (e.g., by the shell walls themselves)

although many other mounting techniques may be used. The upper shell's inner surface 472 extends along the conical walls to a planar back stop or wall 520.

On the back wall 520, the light source or a bulb or diode of the light source 530 is mounted so as to direct its lights into the internal cavity of the housing 422 and through any artwork pattern or filter placed upon the shelves 474, 486. In many instances, the light source 530 is one or more LEDs and the power and the color of this LED(s) may be varied to achieve a desired illumination of the balloon and may depend on the size of the balloon and other design factors. For example, a white LED 530 may be used while in other cases a red-orange LED 530 and/or an amber LED 530 may be used as a projector light source. In other embodiments, the filter 490 is colored to provide color or additional color effects in the display 150. The LEDs may be high powered LEDs to achieve the desired brightness such as 12 VDC, 250 to 350 or higher mA LEDs such as the Luxeon® Star Power Light Sources manufactured by Philips or the like that are also sometime labeled 3 Watt (or higher powered) LEDs that are capable of up to 70 or more lumens brightness. LEDs are used as light source 530 in part in some embodiments because they provide adequate brightness and have extremely long service lives (e.g., up to 100,000 hours). LEDs also run much cooler than incandescent lamps (which may be used as source 530 in some cases). Additionally, LEDs come in a variety of colors that have proven useful to produce a desired color or illumination effect. LEDs also provide a very small point source of light that can be used for imaging a display pattern without the use of lenses (but, of course, lenses may be included in some cases to practice the invention). Further, the light source 530 may be a black light with the inner surface of the balloon acting as the screen being painted with UV luminescent paint. Further, the light source 530 may be controlled to be steady (i.e., powered by the power source or not) or to be blinking or to strobe. Other controls may be added to achieve a desired display effect, and, of course, more than one light source may be utilized to practice the invention (e.g., to mix two light source colors or to light differing portions of the filter with differing colors and/or brightness to achieve a particular image display such as display 150).

The lower shell or shroud 480 extends in a narrowing fashion (e.g., to fit the slot formed by edge 473 in upper shell 470) to an inner edge or back edge upon which mounting sleeves or guides 510 (e.g., 1 or more eyelets or loops similar to door hinge mounts for receiving hinge pins) are provided. The pin or rocker arm 478 is slid through the mounting guides 510 and passed through opening 476 (or otherwise supported by upper shell 470). The back edge of the lower shell 480 and/or the back wall 520 of the upper shell 470 may be configured to provide a travel stop to limit how far the lower shell 480 may open or travel away from the upper shell 470 or the lower shell 470 may be allowed to travel more freely (e.g., rotate only about 90 degrees on the pin 478 or up to 180 to 270 or more degrees about pin 478). To control travel, other devices may be utilized such as a weight attached on the lower shell 480 near the lip by the ledge 486 (e.g., on the exterior side to not be part of the display) or a counterweight may be provided on or near the back edge such as on opposite side of the pin 478 as the shelf 486 to make the lower shell 480 more quickly return to a "closed" position in which the filter or other portions of the shell 480 contact the upper shell 470 (or are more proximate to the shell 470). The lower shell 480 may also be formed into a shape that provides more controlled travel or rocking such as by shaping the shell 480 in a "V" or "L" shape with the elbow or valley placed at or over the rocker arm 478. Other techniques such as springs and magnets may be used to close the shells 470, 480 or to cause the shells 470, 480 contact each other when in a position of rest or in a default display position. Also, springs or other flexible members may be used for mounting the art work or filter 490 to provide movement, and in some cases, magnets may be used to provide low resistance hinges in place or in addition to the arrangement shown in FIGS. 4 and 5. The movement of the lower shell 480 relative to the upper shell 470 is shown by line 481 as the shell 480 pivots on the pin 478 in response to movement of a balloon upon which the housing 422 is mounted (e.g., with the shelves 474, 486 proximate to the outer or exterior surface of the rear wall of a balloon so as to shine the light of the source 530 through a window provided in the wall or through the clear fabric of the wall).

Figure 6:
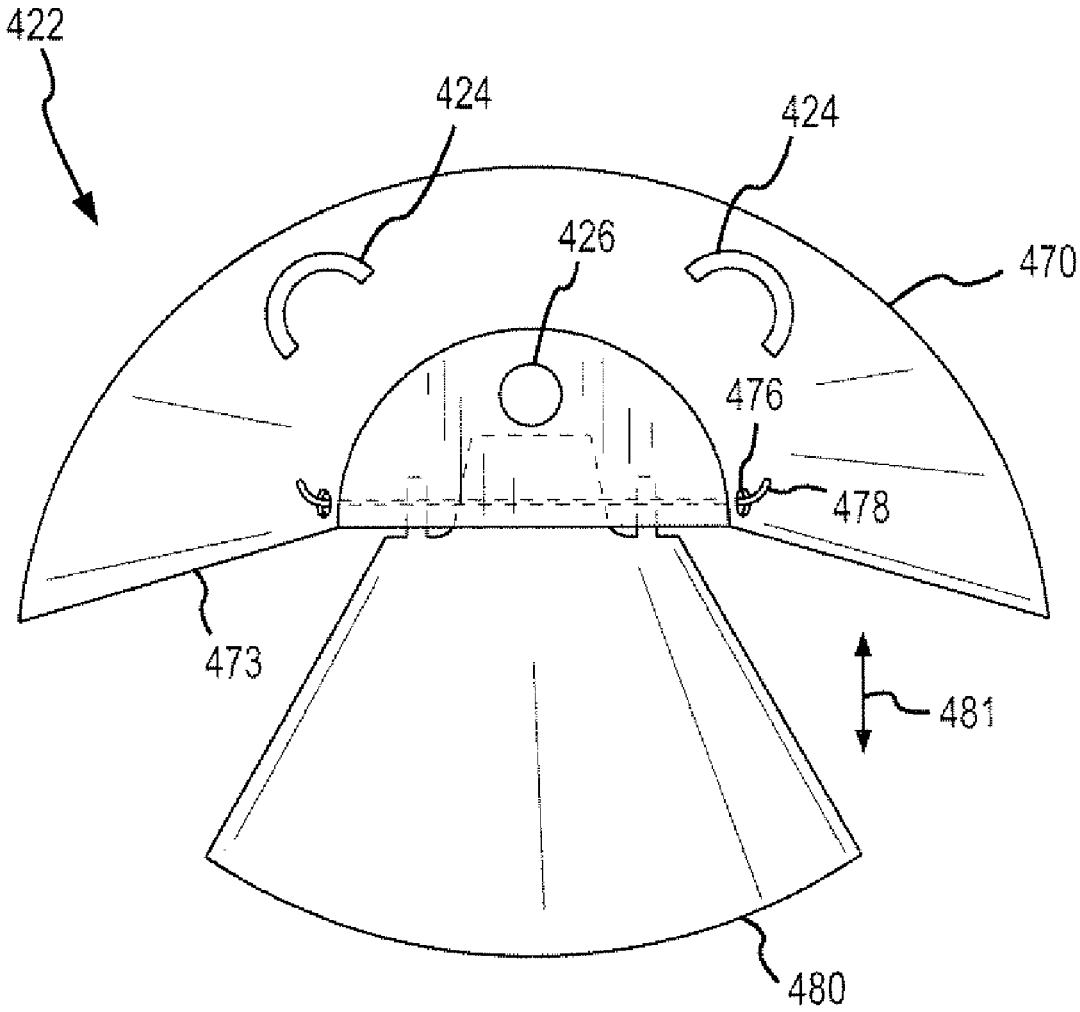
FIG. 6 is a back end view of the projector shroud or shell shown in FIGS. 4 and 5 with the lower or bottom part of the shroud at a closed position in which it is at the top of its travel (e.g., contacting the inner surface of the upper or top part of the two piece shroud or shell.

FIG. 6 illustrates another end view of the projector housing 422. i.e., the rear or back view as would be seen when viewing the rear wall of a balloon after mounting. In this view, the light source has not yet been installed. As shown, the upper shell 470 includes a pair of guides 424 through which mounting straps (such as rubber bands, string, wire, or the like) may pass to strap the housing 422 to a balloon. The edge 473 of the upper shell 470 defines a receiving slot or bay for the lower shell 480 which can be moved 481 up into and out of a closed or uppermost position (e.g., a position in which a portion of the shell 480 or mounted artwork pattern or filter contacts a portion of the upper shell 470 although such contact is not necessary to practice the invention). The rear wall of the upper shell may include mounting structure 426 for a light source such as a tubular extension with a hole through which the power/control cords or wires for the source may pass or to support a battery (e.g., a watch battery or the like) and/or portions of the source such as a bulb, a diode, and/or other wiring/electronics. Again, the pin or rocker arm 478 is shown to extend out from the upper housing 470 through holes or openings 476, and the upper shell 470 or its wall thus provides a physical support for the pin 478 and the lower shell 480 that is positioned onto the pin 478. The housing 422 and its shells or shrouds 470, 480 are generally formed of an opaque material or substantially light blocking material so as to direct the light from the source out the opening in the end of the housing 422 to create a display. In some cases, the housing 422 is formed of plastic but other materials such as Styrofoam® or similar material, metal, wood/paper products, or the like may be used. The pin 478 typically is formed of metal but also can be made of other materials to practice the invention, and, as discussed above, many other mounting techniques well known in the arts may be used mount the two shells 470, 480 together so as to allow the lower shell or shroud 480 to pivot about the mounting location on the upper shell or shroud 470 (e.g., a hinge or similar arrangement may be used).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the embodiments depicted in the figures used a lower shell or shroud piece that pivoted or rocked on a pin or rod so as to move a portion of the light filter or display pattern/artwork relative to a stationary portion of the filter/artwork. In other implementations not shown, the movement of a portion of the light filter is achieved by a piece of the filter or pattern moving in other manners such as sliding within a groove or slot with the movement of the balloon or within an enclosure or cage (such as eye pupil) or being mounted upon a spring or other flexible member. The power cord 128 may comprise a laminated conductor that provides a tether such as a plastic or other electrical insulator material cord with a copper or other electrically conductive ribbon or wire embedded or provided therein. These embodiments are believed within the breadth of the description and the claim language that follows.

Additionally, the embodiments generally show a two pieced housing construction with an upper and a lower portion or shell. It will readily be understood that the moving portions may be one, two, three, or more with each shell optionally including its own artwork pattern or light filter for affecting the display. For example, the lower shells may include artwork patterns that display arms or legs such as a night and a left leg respectively and separate movement of the lower shell portions may be desirable and is considered within the breadth of this description. Likewise, the moving portion of the projector housing may be provided so as to move side to side rather than up and down as illustrated (e.g., generally on a horizontal plane rather than to pivot on vertically).

Yet further, the movement of the artwork pattern or filter may be achieved within a more unitary shell or shroud. For example, the pivoting or rocking light filter may be provided on a hinge or pin within a shell that extends in a complete conical shape and be provided as a subcomponent within the projector housing (e.g., small moving patterns on individual or shared rocker arms or pins that representing moving pupils or eyelids or other moving effects within a larger, non-moving or stationary pattern or filter or these may be combined with the embodiments illustrated in FIGS. 1-6).

In some embodiments, the image display (such as display 150 in FIG. 1) will farther include portions that are provided on the front wall or the rear wall of the balloon. For example, the front wall may include artwork or designs (e.g., a non-projected portion of the display) that are visible when the light source is not operated and that are altered or added to in a complimentary fashion when the light source is added and stationary and animated portions from the projector are added or projected onto the front wall or screen of the balloon. In other cases, a portion or all of the stationary image (e.g., components 152, 154 of FIG. 1) may be provided on the rear wall of the balloon such as designs or artwork painted on or applied later such as with writing or decals or the like. The use of such rear wall components in the display would involve mounting the projector such that the outlet of the projector housing at least partially overlaps such display components. Yet further, the display may include stationary or mobile or movable components that are provided in the interior of the balloon. The art work or filter may also be a digital filter such as may be provided with a translucent LCD or the like so as to provide the motion with the changing of the filter pattern rather than or in addition to movement of the art work or filter components. The animation may also be provide by or supplemented by providing a movable light source with stationary or partially stationary art work or filter components. For example, the light source may be mounted on a support that is pivotally mounted or attached with a spring to the projector housing, and by moving the light source, the display will appear to have moving or animated portions.

The size and shape of the balloon can also vary significantly to practice the invention with many unusual shapes being well suited for the invention such as cylindrical, and the description is intended to describe the use of the motion animated projector that is rear and externally mounted with nearly any inflated object (e.g., with a screen surface and a projector surface that has at least a portion that is clear or at least translucent to light). The invention is also not limited to balloons but may readily be used with other inflated objects such as those used for lawn ornaments with animation occurring due to wind moving the object (or "balloon" is to be considered as a relatively generic term to mean nearly any inflated object). The position of the projector is not limiting as the projector may be on the "front" wall of the balloon on the top or bottom of the balloon with "front" and "rear" wall being used as terminology that is interchangeable with "first" and "second" wall or first and second locations or positions upon the balloon or inflatable device or structure.

I claim:

1. An illuminated inflatable display apparatus, comprising:

an inflatable balloon comprising a front wall and a rear wall, wherein the rear wall includes an area that is at least partially transparent to light; and a projector positioned exterior to and adjacent the rear wall of the balloon, the projector comprising a housing with an outlet proximate the transparent area of the rear wall, a light source directing light toward the housing outlet, and a light filter element positioned in the housing, wherein the light from the light source passes selectively through the light filter element to project a display image defined by the light filter element on an inner surface of the front wall of the balloon, wherein the housing comprises a first shell supporting the light source and a second shell that is pivotally mounted onto the first shell, the first and second shells defining the outlet of the housing and the first shell abutting an exterior surface of the rear wall, whereby the first shell is immobile relative to the rear wall and the second shell moves relative to the first shell, wherein the light filter element comprises a first component attached to the first shell and a second component attached to the second shell, the first component defining a stationary portion of the display image and second component defining a mobile portion of the display image, wherein the second shell is mounted to move generally vertically toward and away from the first shell with the second shell being supported on the first shell with a pin passing through mounting guides on the second shell.

2. The apparatus of claim 1, wherein the light filter element comprises an animated portion mounted to the housing to move independently relative to the housing.

3. The apparatus of claim 2, wherein the animated portion is mounted upon a flexible member attached to the housing.

4. The apparatus of claim 1, wherein the first shell has a frustoconical sidewall formed of a substantially opaque material that includes a slot sized to receive the second shell as the second shell pivots about its mounting to the first shell.

5. The apparatus of claim 1, wherein the front wall is colored white and the rear wall is substantially transparent to light.

6. The apparatus of claim 1, further comprising a mounting assembly attaching the projector the rear wall comprising a guide on the rear wall, a guide on the project housing, a strap passing through the rear wall guide and the projector housing guide, and a forward guide on the front wall of the balloon at an offset distance from the center of the balloon through which a power cord from the light source may be extended, whereby the power cord acts as an attachment strap and also as a tether for the balloon.

7. An illuminated balloon assembly, comprising:

a balloon; and a projector mounted on an exterior surface of the balloon, wherein the projector comprises a stationary shroud contacting the exterior surface of the balloon, a light source supported by the stationary shroud, and a mobile shroud mounted on the stationary shroud to move relative to the stationary shroud, wherein inner surfaces of the shrouds direct light from the light source through a portion of the balloon that is substantially transparent to light onto an inner surface of the balloon, wherein the mobile shroud is pivotally mounted onto the stationary shroud, and wherein the projector further comprises an artwork pattern at least partially opaque to light, the pattern comprising a first portion attached to the stationary shroud and a second portion attached to the mobile shroud, wherein the first and second portions are in a path of the light from the light source to filter portions of the light from the light source with the second portion moving vertically toward and away from the first portion with movement of the balloon.

8. The assembly of claim 7, wherein the stationary shroud includes a substantially opaque sidewall with a slot through which the mobile shroud travels as it pivots on the stationary shroud.

9. The assembly of claim 7, wherein the light source comprises a light emitting diode powered from a power source external to the shrouds.

10. The assembly of claim 7, wherein the balloon comprises a front wall comprising the inner surface upon which the light from the light source is directed, the front wall being at least partially opaque to light.

11. The assembly of claim 7, further comprising a mounting assembly attaching the projector to the exterior surface of the balloon comprising a guide on the exterior surface, a guide on the projector housing, a strap passing through the rear wall guide and the projector housing guide, and a forward guide on the exterior surface of the balloon through which a power cord from the light source may be extended, whereby the power cord acts as an attachment strap and also as a tether for the balloon.

12. The apparatus of claim 11, wherein the light source is mounted on the inner surface of the upper shell and comprises a light emitting diode.

13. An apparatus for forming a balloon with a wall with a transparent portion into an illuminated balloon display device, comprising:

an upper shell with an inner surface supporting an upper display pattern and adapted for mounting upon an exterior surface of the balloon wall adjacent the transparent portion;

a light source positioned to direct light onto the upper display pattern on the inner surface of the upper shell; and a lower shell with an inner surface supporting a lower display pattern, wherein the lower shell is pivotally mounted to the upper shell to move the lower display pattern toward and away from the inner surface of the upper shell and wherein the upper and lower display patterns are at least partially opaque to light, wherein the inner surface of the upper shell has an arcuate cross section with a gap sized to receive the lower shell as it moves toward the inner surface.

14. The apparatus of claim 13, further comprising a mounting assembly for attaching the upper shell to the exterior surface of the balloon comprising a guide on an outer surface of the upper shell, a strap for passing through the upper shell guide and through a guide on the exterior surface of the balloon, and a power cord from the light source extending out of the upper shell to a power source for the light source housed in a handle, whereby the power cord acts as an attachment strap as it passes through one or more guides on the exterior surface of the balloon.

15. The apparatus of claim 13, wherein the lower shell has an outer edge that is recessed from a plane passing through an outer edge of the upper shell, whereby the lower shell does not contact the exterior surface of the balloon when the upper shell is mounted on the exterior surface.

16. An illuminated inflatable display apparatus, comprising:

an inflatable balloon comprising a front wall and a rear wall, wherein the rear wall includes an area that is at least partially transparent to light; and a projector positioned exterior to and adjacent the rear wall of the balloon, the projector comprising a housing with an outlet proximate the transparent area of the rear wall, a light source directing light toward the housing outlet, and a light filter element positioned in the housing, wherein the light from the light source passes selectively through the light filter element to project a display image defined by the light filter element on an inner surface of the front wall of the balloon, the light filter comprising a first portion and a second portion mounted to move toward and away from the first portion during movement of the projector to create a vertically moving portion in the display image.

17. The display apparatus of claim 16, further comprising a mounting assembly attaching the projector the rear wall comprising a guide on the rear wall, a guide on the project housing, a strap passing through the rear wall guide and the projector housing guide, and a forward guide on the front wall of the balloon at an offset distance from the center of the balloon through which a power cord from the light source may be extended, whereby the power cord acts as an attachment strap and as a balancing tether for the balloon.

* * * * *